US006840850B2

(12) United States Patent
Bancon

(10) Patent No.: US 6,840,850 B2
(45) Date of Patent: Jan. 11, 2005

(54) ABRASIVE GRINDSTONE AND METHOD FOR MAKING SAME

(75) Inventor: Georges Bancon, Chalon sur Saone (FR)

(73) Assignee: Saint-Gobain Abrasifs Technologie et Services, Conflans-Saint-Honorine (FR)

( * ) Notice: Subject to any disclaimer, the term of this patent is extended or adjusted under 35 U.S.C. 154(b) by 0 days.

(21) Appl. No.: 10/169,740

(22) PCT Filed: Jan. 17, 2001

(86) PCT No.: PCT/FR01/00146

§ 371 (c)(1),
(2), (4) Date: Oct. 22, 2002

(87) PCT Pub. No.: WO01/53041

PCT Pub. Date: Jul. 26, 2001

(65) Prior Publication Data

US 2003/0162488 A1 Aug. 28, 2003

(30) Foreign Application Priority Data

Jan. 17, 2000 (FR) ..... 00/00536

(51) Int. Cl.[7] ..... B23F 21/03
(52) U.S. Cl. ..... 451/544; 451/546
(58) Field of Search ..... 451/540, 541, 451/544, 545, 546, 547, 548, 549, 550, 542

(56) References Cited

U.S. PATENT DOCUMENTS

| | | | | |
|---|---|---|---|---|
| 2,097,803 A | * | 11/1937 | Sanford | 451/546 |
| 2,910,810 A | * | 11/1959 | Fuchs | 451/546 |
| 4,341,532 A | * | 7/1982 | Oide | 51/297 |

FOREIGN PATENT DOCUMENTS

| | | | | |
|---|---|---|---|---|
| EP | 0355732 | * | 8/1989 | B24D/5/04 |
| GB | 1 540 511 | | 2/1979 | |
| JP | 06 312377 | | 11/1994 | |
| JP | 08 290362 | | 11/1996 | |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

A grindstone exhibiting good abrasive properties while being inexpensive and including stacked layers. The stacked layers include at least one layer of abrasive grain, which in turn includes juxtapose zones of different abrasive grains, one of these zones being proximate to the center of the at least one layer and another of the zones extending along the outer periphery of the at least one layer. A method for forming the at least one layer makes a blank of a first type of abrasive grains and a ring of a second type of abrasive grains. Respective inner and outer contours of the blank are geometrically similar. The ring and the blank are positioned in an inserting position, and then in a subsequent step for making the grindstone, the stack of layer is pressed. Such a grindstone and method can be useful for making cutting-off and surface-treating wheel, as an example.

18 Claims, 3 Drawing Sheets

ABRASIVE GRINDSTONE AND METHOD FOR MAKING SAME

BACKGROUND OF THE INVENTION

1. Field of the Invention

The invention relates to an abrasive grinding wheel in the form of a thin grinding wheel, provided with a plurality of stacked layers of constituents bonded by pressure.

2. Description of the Related Art

Such grinding wheels are made by stacking, generally around a central metal bushing, a protective paper disk, a reinforcing sheet generally of cloth or similar meshed, perforated or honeycombed material, a layer of abrasive grains, another reinforcing sheet, also generally of cloth or similar material, and if necessary another protective paper disk; thereupon the stack is generally heated; then it is pressed and, as a result, the layer of abrasive grains and the meshed, perforated or honeycombed reinforcement layers are generally made to interlock at least partly as a result of penetration of the abrasive grains into the meshes, perforations or honeycombs.

At present, these grinding wheels have an offset hub, meaning that the part of the grinding wheel that is in the immediate vicinity of the central bushing does not extend in the same plane as the part surrounding it, and the grinding wheel is mounted on the grinding machine in such a way that this part most distant from the bushing projects the most beyond the machine; the grinding wheel is therefore generally used for surface treatment only on the surface of this part situated on the side opposite the machine; for cutting-off operations, it is naturally the circumference of the same part that is subjected to the greatest load. It is therefore essential that this part contain very high-performance grains, and it is uselessly costly for the part close to the bushing to contain the same abrasive grains, as is the case in conventional grinding wheels.

Furthermore, during rotation of the grinding wheel, the circumferential velocity of the abrasive grains close to the circumference is very much higher than that of the grains closer to the bushing, and so the optimal abrasives for the two regions are not necessarily the same.

SUMMARY OF THE INVENTION

The object of the invention is to overcome these disadvantages of known grinding wheels and, to this end, it relates to an abrasive wheel in the form of a thin grinding wheel, provided with a plurality of stacked layers of constituents, characterized in that it contains at least one layer of abrasive grains which is provided with adjacent regions composed of different abrasive grains, and one of these regions extends to the vicinity of the center of the layer while another of these regions extends along the outer periphery of the layer.

By virtue of this structure, the grinding wheel according to the invention can be composed of abrasive grains that are perfectly adapted to the function that they must assure, even if the grinding wheel is composed of regions of different functions.

The grinding wheel according to the invention can also have one or more of the following characteristics:

in the layer of abrasive grains provided with a region extending to the vicinity of the center and a region extending along the periphery of the layer, composed of different abrasive grains, these two regions are adjacent to one another;

in the layer of abrasive grains provided with adjacent regions composed of different abrasive grains, at least two of these regions are adjacent to one another along a joint line having a circular shape;

in the layer of abrasive grains provided with adjacent regions composed of different abrasive grains, at least two of these regions are adjacent to one another along a closed joint line having a noncircular shape;

the grinding wheel is provided with at least two layers of abrasive grains, of which at least one is provided with adjacent regions composed of different abrasive grains, one of these regions extending to the vicinity of the center of the layer while another of these regions extends along the periphery of the layer; and the grinding wheel is provided with openings.

The invention also relates to a process for production of an abrasive grinding wheel as defined hereinabove, characterized in that, to produce at least one layer of abrasive grains, there is produced on the one hand a blank that is provided if necessary with a central hole and that is composed of abrasive grains of a first type, and on the other hand at least one ring composed of abrasive grains of a second type, the inner contour of the ring and the outer contour of the blank being geometrically similar, and then, to produce the grinding wheel, the ring and the blank are placed in insertion relationship, if necessary on a reinforcing layer, another reinforcing layer if necessary is superposed on the blank and the ring in insertion relationship and, in a subsequent stage of the production process, the stack of layers of constituents is pressed.

By virtue of this process, it is possible to make a grinding wheel containing at least one layer of abrasive grains that is provided with concentrically disposed regions composed of different abrasive grains, without imbalance capable of causing destruction of the grinding wheel at the recommended working speeds, this being achieved with a large safety margin.

The process can also have one or more of the following characteristics:

prior to the pressing step, the stack of layers of constituents is heated;

a blank provided with a central hole is disposed on a reinforcing layer by threading its central hole around a bushing, around which there is already threaded the reinforcing layer, and then the ring is disposed around the blank to ensure that the ring and the blank are in insertion relationship on the reinforcing layer;

there are successively superposed at least a reinforcing layer, a layer of abrasive grains, a reinforcing layer, a layer of abrasive grains and a reinforcing layer and, to produce at least one of the layers of abrasive grains, there are produced on the one hand a blank and on the other hand at least one ring having respectively an outer contour and an inner contour which are geometrically similar, the blank and ring being placed in insertion relationship.

Another object of the invention is an installation for production of an abrasive grinding wheel, characterized in that it comprises:

a machine for producing, from abrasive grains of a first type, blanks which are provided if necessary with a central hole, a machine for producing rings from abrasive grains of a second type, the inner contour of the ring and the outer contour of the blank being geometrically similar, an assembly line containing a station for placing the rings and the blanks in insertion relationship, and a pressing machine.

BRIEF DESCRIPTION OF THE DRAWINGS

Other characteristics and advantages of the invention will become evident from the description given hereinafter of embodiments of the invention and of production methods for these embodiments, which are presented as nonlimitative examples and are illustrated by the attached drawings, wherein.

DETAILED DESCRIPTION OF THE INVENTION

Figure 1:
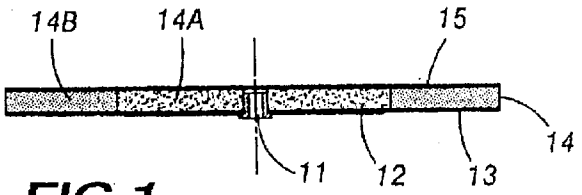
FIG. 1 is a schematic cross section of a first embodiment of a grinding wheel according to the invention.

The grinding wheel in the form of a thin grinding wheel according to the invention, as illustrated in FIG. 1, is provided with stacked layers of constituents threaded around a central metal bushing 11, the said layers being more precisely a protective disk 12, generally composed of a paper sheet or similar sheet, referred to as "paper", a reinforcing layer 13 referred to as "cloth", which can actually be of cloth or of a preferably meshed, perforated or honeycombed material, a layer 14 of abrasive grains, another reinforcing layer 15, which is generally identical to the first, and if necessary another "paper" protective disk.

Since the production of such a grinding wheel includes a pressing phase, the layer 14 of abrasive grains and the meshed, perforated or honeycombed reinforcing layers 13, 15, are generally made to overlap at least partly by the penetration, into the meshes, perforations or honeycombs, of the abrasive grains of which layer 14 is composed.

In addition, the layer 14 of abrasive grains is provided with adjacent regions, in the present case two concentric regions 14A, 14B, composed from abrasive grains of different characteristics, one of these regions extending to the vicinity of central bushing 11 while the other region surrounds the first and extends along the outer periphery of the layer of abrasive grains.

The joint line between regions 14A, 14B composed of different abrasives is a closed line that in this case extends as a circumference centered on the axis of central bushing 11.

Figure 2:
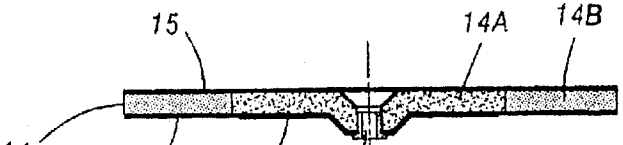
FIG. 2 is a schematic cross section of another version of the grinding wheel of FIG. 1, FIGS. 3 and 4 are diagrams respectively showing in cross section two phases of production, in a mold, of a component of the grinding wheel of FIG. 1, FIGS. 5 and 6 are diagrams respectively showing in cross section two phases of production, in a mold, of another component of the grinding wheel of FIG. 1.

Since the grinding wheel illustrated in FIG. 2 is identical to that of FIG. 1 with the exception that the portion of the grinding wheel disposed in the vicinity of central bushing 11 does not extend in the same plane as the portion surrounding it, the description of FIG. 1 is also applicable to FIG. 2, and the components of the grinding wheel of FIG. 2 are represented by the same reference symbols as the corresponding components of FIG. 1; in this case region 14A close to the central bushing has an offset profile, and region 14B surrounding it is plane, although in an alternative version region 14A could have a smaller surface area and be plane, and region 14B could then have an offset profile.

The grinding wheel according to the invention can also be provided with a plurality of successively stacked layers composed of abrasive grains, such as layer 14 of abrasive grains, a "cloth" reinforcing layer being inserted between each two layers of abrasive grains.

It is conceivable that the grinding wheels according to the invention can be produced by the conventional process wherein

- central bushing 11 is disposed in a mold placed on a production platen and around it there are successively placed protective disk 12, reinforcing sheet 13 and the different pulverulent products formed from abrasive grains of different types provided with a coating composed of a binder, distributed in the mold as a function of the geometry to be imparted to the two regions composed of different abrasives,
- layer 14 of pulverulent products is doctored in order to reduce its thickness to the desired value,
- a second reinforcing layer 15 is superposed on the layer of pulverulent products,
- if necessary a layer of pulverulent products is deposited and a reinforcing layer is superposed as many times as necessitated by the type of grinding wheel to be produced, and a second protective sheet is superposed,
- and the stack obtained is compressed in a press.

However, besides the fact that the known installations permitting use of this process are generally bulky and costly, function at a relatively slow rate, are subject to frequent breakdowns due to the inevitable presence of abrasive grains throughout the machine, and are not very amenable to improvement, the process entails the risk that distribution of the abrasive products cannot be perfectly controlled, thus resulting in the production of grinding wheels having unacceptable imbalance.

It is for this reason that the grinding wheels according to the invention are advantageously produced by replacing the deposition of pulverulent products formed from abrasive grains provided with a coating by the deposition of an abrasive blank, which itself is produced as will be seen hereinafter from such abrasive grains and, in the case of the abrasive layer or layers with two concentric regions, by the deposition of an abrasive blank and of an abrasive ring produced in the same manner and placed in insertion relationship, thus eliminating the doctoring phase, and continuing the process by superposing a reinforcing layer on the blank and ring in insertion relationship.

In the case of a grinding wheel with a plurality of layers of abrasive grains, it is possible to make one, several or all of these layers in this manner.

The abrasive blank and abrasive ring can be produced by means of a process and of a machine such as those described in detail in French Patent 99-07282 of the Applicant, wherein the blanks and rings can be produced without the disadvantages mentioned hereinabove and in particular with remarkably good balance.

In short, the blank-producing machine is provided with a stepping production turntable of generally circular shape provided with, for example, four sectors equipped with molds and with specialized fixed working stations for performing respectively the different production tasks or operations on the contents of the molds as they pass opposite such stations; thus a plurality of blanks can be undergoing production simultaneously on the table. The machine is also provided with a temporary storage turntable on which the blanks produced on the production table are aligned and/or stacked before being removed for transfer to an assembly line.

The stations with which the machine is equipped are a station for pouring in abrasive product comprising abrasive grains provided with a coating composed of a binder, a station for leveling by doctoring, a pressing station, a station for discharge of the blanks, and a station for cleaning the table.

Figure 4:
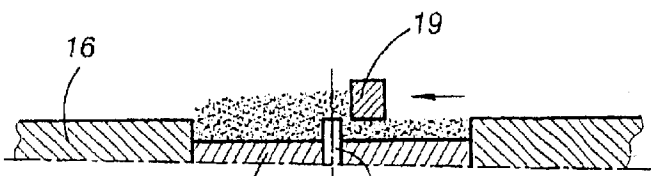
Figure 3:
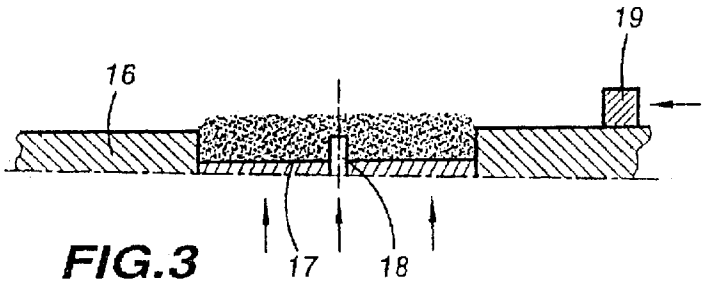

The molds (FIGS. 3 and 4) are of generally cylindrical shape and are provided with a side wall 16, inside which there is mounted a sliding bottom 17 designed to slide in vertical direction and provided with a central core 18.

The station for pouring in abrasive is equipped in its upper portion with a reservoir of abrasive product: in its lower portion, the pouring station has a closable slot so that the product can be poured into the mold when this is positioned under the slot, the bottom of the mold being positioned inside the side wall at a depth greater than the thickness desired for the blank.

Since a slight excess of abrasive product is poured in, a leveling doctor 19 wipes off product until it is flush with side wall 16 of the mold.

The pressing station compresses the product with a force on the order of several metric tons (or tens of thousands of newtons), thus forming the blank that will be introduced into an assembly line, to be described hereinafter.

The discharge station transfers the blanks from the production table to the intermediate storage table.

The cleaning station cleans the sector of the table passing opposite it, downstream from the discharge station.

Thus, in the present case in which each of the four sectors of the table is equipped with a single mold, the situation is that, simultaneously or almost so, one mold is being filled, one mold is being doctored, one blank is being pressed and one blank is being discharged from the production table.

Figure 6:
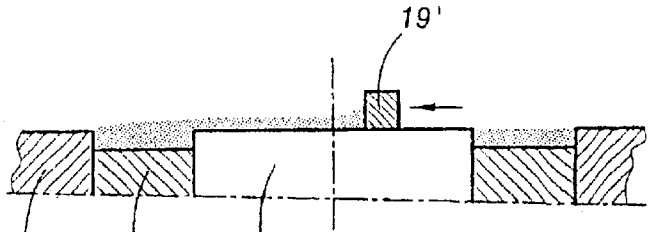
Figure 5:
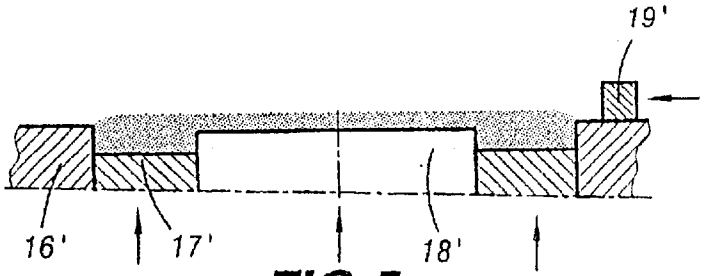

The ring-producing machine can be identical to the blank-producing machine, except for the shape and dimensions of the molds (FIGS. 5 and 6); in this case the molds are of generally cylindrical shape and are provided with a side wall 16', inside which there is mounted a sliding bottom 17' designed to slide in vertical direction and provided with a central core 18'. A leveling doctor 19' wipes off excess abrasive product until it is flush with side wall 16' of the mold. The description of the production machine and its operation will therefore not be repeated.

By virtue of the fact that the blanks and rings are produced in a form ready for introduction into an assembly line, it is easier to produce grinding wheels of different dimensions and also to switch from "one-layer" grinding wheels to "multi-layer" grinding wheels.

In fact, since the devices of the stations are not very complex, they can be exchanged very quickly in the event of production change or breakdown; in addition, the dimensions of the grinding wheels can be advantageously chosen such that a blank of given dimensions can be introduced into the production of a grinding wheel of relatively small diameter having a single type of abrasive grains, and can be used as central blank in a grinding wheel of larger diameter having two types of abrasive grains; for example, a 75 mm blank can be used to form the central region of a 125 mm grinding wheel having two types of abrasive grains.

In addition, the turntable has relatively small dimensions (the diameter can be reduced to a value smaller than one meter), and the molds used exclusively for production of blanks and rings are lightweight (weighing less than 15 kg).

The pressing force to be exerted on the abrasive product to form the blanks and rings one-by-one is relatively moderate, on the order of several metric tons (or tens of thousands of newtons), for about one second.

Consequently, a production rate of 1000 blanks or 1000 rings per hour can easily be achieved with a turntable equipped with four molds.

In addition, since the abrasive product is present in the assembly line only in the form of blanks and rings and no longer in pulverulent form, the wear of the assembly line in which the layers of constituents are stacked is appreciably reduced.

Figure 7:
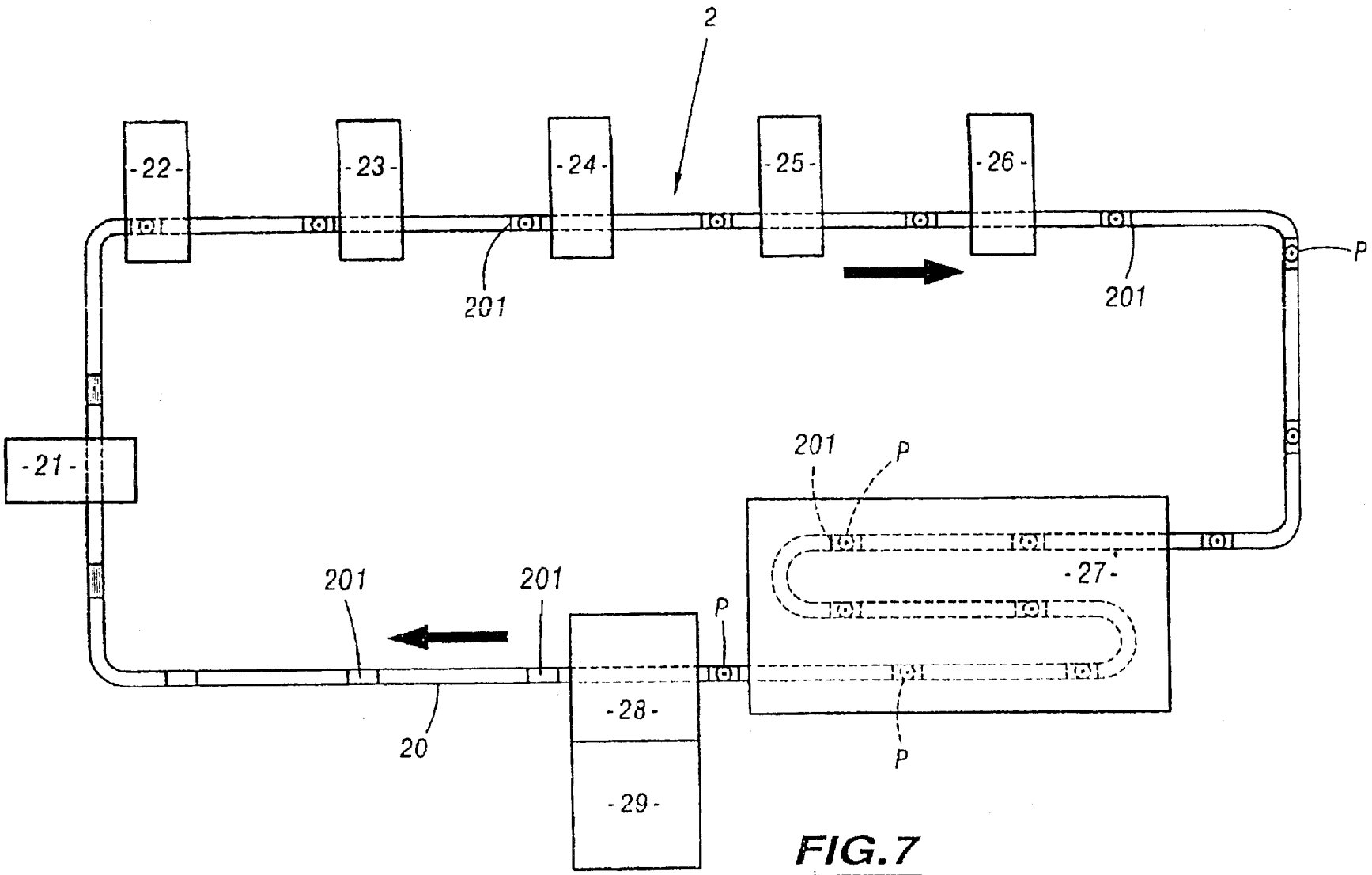
FIG. 7 is a schematic view from above of an assembly line with which there is associated a pressing machine, for operation of the process of production of abrasive grinding wheels according to the invention.

The assembly line illustrated by the diagram of FIG. 7 is intended for production of grinding wheels having a single layer of abrasive grains and therefore comprising a blank and a ring in this case.

It is provided with a conveyer 20 traveling in a closed loop, along which there are disposed specialized fixed working stations for performing respectively the different operations of production of the grinding wheel proper. This conveyor carries platens fixed thereon and designed to receive movable platens 201, on which the different elements, and in particular the different layers of constituents of the grinding wheels are progressively stacked one upon the other during the passage of the conveyer.

More precisely, the assembly line is provided successively in travel direction of conveyer 20 with a station 21 for placing central bushings, a station 22 for placing base "papers", a station 23 for placing lower reinforcing layers, a station 24 for placing blanks, a station 25 for placing rings, a station 26 for placing upper reinforcing layers, if necessary a station for placing upper "papers" (not illustrated), in this case a heating station 27, and a discharging and recharging station 28.

Each working station intended for superposing a layer of constituent is provided with a stock of stacks, each carried by a movable platen 201, and so an interruption of short duration in the functioning of one of the stations, due to a breakdown, for example, does not completely interrupt production of the grinding wheels, since the working stations situated downstream work on their stock and the upstream working stations can be instructed to build up their stock. In this way desynchronization of the production operations is advantageously achieved under these conditions.

Heating station 27 provided here heats the stacks P passing through it to a temperature of about 50 to 80° C., facilitating a slight flow of the abrasive product comprising the blanks into the holes of the reinforcing layer, such as the meshes in the case of a genuine cloth or analogous material.

Since each station performs a single superposition operation, the assembly line possesses a certain modularity, and an increase in the number of layers can be achieved simply by adding the appropriate number of stations; for example, to produce grinding wheels with two layers of abrasive grains, it is sufficient to add to the assembly line just described a station for placing blanks, a station for placing rings and a station for placing reinforcing layers.

In the case in which the reinforcing layers or "cloths" are delivered lined with the "paper" layer, the two stations for placing "paper" and for placing "cloth" respectively, one immediately following the other, are replaced by a single station.

Obviously the placing stations can be automated or manual.

Downstream from the assembly line, the installation is provided with a pressing machine 29, into which the movable platens with their contents exiting heating station 27 are transferred by discharging and recharging station 28; as an alternative, this pressing machine could be made part of the assembly line.

Pressing machine 29 is similar to that of French Patent 99-07282 of the Applicant. Since the abrasive products are already in the form of blanks and rings, the duration of the pressing stage is relatively short and, since each press works on only one stack, the pressing force can remain relatively moderate (on the order of 20 metric tons, or around $2.10^5$ N).

The grinding wheels discharged from pressing machine 29 are then transferred in known manner into another furnace, where they will be annealed before being stored while awaiting delivery.

Figure 8:
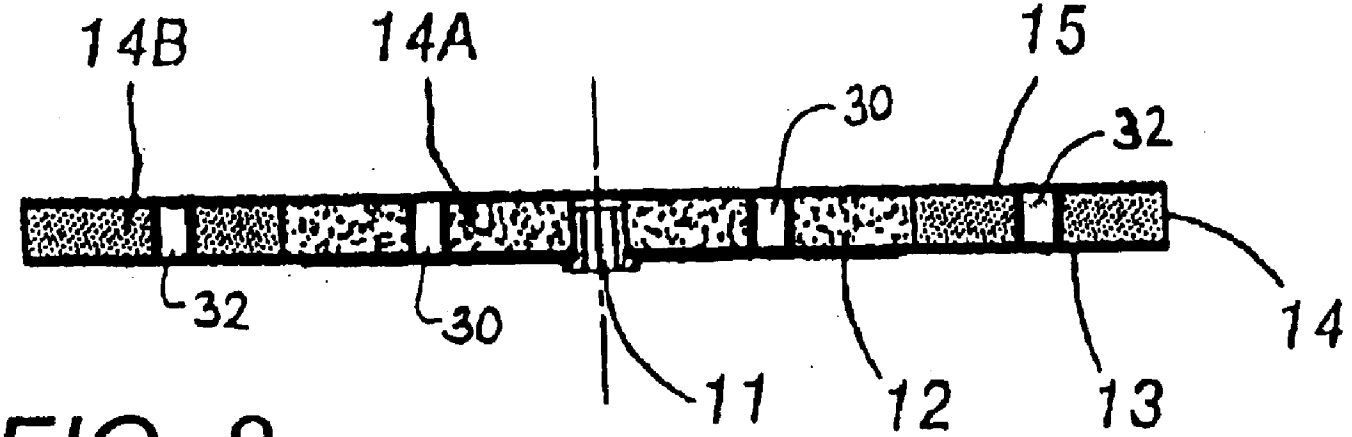
FIG. 8 is a schematic cross section of a further version of the grinding wheel of FIG. 1.

The invention is of course not limited to the examples described and illustrated hereinabove, and other forms thereof can be provided without departing from the scope of the invention. For example, it is possible to produce grinding wheels having two (or more) types of abrasive grains, wherein one or more adjacent regions has or have openings, which are formed, for example, during molding. For example, FIG. 8 depicts an embodiment having openings 30 and openings 32.

What is claimed is:

1. An abrasive grinding wheel in a form of a thin grinding wheel, comprising:

a plurality of stacked layers of constituents, including at least one layer of abrasive grains provided with adjacent regions composed of different abrasive grains, and a first of the adjacent regions extends to a vicinity of a center of the at least one layer while a second of the adjacent regions extends along an outer periphery of the at least one layer, wherein said plurality of stacked layers further includes a reinforcing layer that extends over the adjacent regions.

2. An abrasive grinding wheel according to claim 1, wherein the first and second regions are adjacent to one another.

3. An abrasive grinding wheel according to claim 1, wherein at least two of the adjacent regions are adjacent to one another along a joint line having a circular shape.

4. An abrasive grinding wheel according to claim 1, wherein at least two of the adjacent regions are adjacent to one another along a closed joint line having a noncircular shape.

5. An abrasive grinding wheel according to claim 1, wherein the at least one layer comprises at least two layers of abrasive grains, of which at least a first layer is provided with the adjacent regions composed of different abrasive grains, a first of the adjacent regions extending to the vicinity of the center of the at least one layer while a second of the adjacent regions extending along the periphery of the layer.

6. An abrasive grinding wheel according to claim 1, further comprising openings.

7. A process for production of an abrasive grinding wheel according to claim 1, comprising the steps of:

producing the at least one layer of abrasive grains by providing a blank with a central hole and that is composed of abrasive grains of a first type, and providing at least one ring composed of abrasive grains of a second type, wherein an inner contour of the at least one ring and an outer contour of the blank are geometrically similar;

producing the grinding wheel by placing the ring and the blank in insertion relationship, and superposing a first reinforcing layers on the blank and the ring; and pressing the stack of layers of constituents.

8. A process for production of an abrasive grinding wheel according to claim 7, wherein, prior to the pressing, the stack of layers of constituents is heated.

9. A process for production of an abrasive grinding wheel according to claim 7, wherein the blank provided with a central hole is disposed on the first reinforcing layer by threading its central hole around a bushing, around which there is already threaded the first reinforcing layer, and then the ring is disposed around the blank to ensure that the ring and the blank are in insertion relationship on the first reinforcing layer.

10. A process for production of an abrasive grinding wheel according to claim 7, wherein there are successively superposed at least the first reinforcing layer, a first layer of abrasive grains, a second reinforcing layer, a second layer of abrasive grains, and a third reinforcing layer and, to produce the at least one layer of abrasive grains, there are produced a blank and at least one ring having respectively an outer contour and an inner contour that are geometrically similar, the blank and ring being placed in insertion relationship.

11. An installation for production of an abrasive grinding wheel according to claim 7, comprising:

a machine for producing, from abrasive grains of the first type, blanks that are provided if necessary with a central hole, a machine for producing rings from abrasive grains of the second type, the inner contour of the ring and the outer contour of the blank being geometrically similar, an assembly line containing a station for placing the rings and the blanks in insertion relationship, and a pressing machine.

12. An installation according to claim 11, wherein at least one of the blank-producing machine and the ring-producing machine is equipped with a stepping production turntable provided with a station for pouring in abrasive product, a station for leveling by doctoring, a pressing station, a station for discharge of the blanks, and a station for cleaning the table.

13. An installation according to claim 12, wherein at least one of the blank-producing machine and the ring-producing machine is further provided with a station for intermediate storage of at least one of the blanks and rings before they are transferred to the assembly line.

14. An installation according to claim 13, wherein the ring-producing machine contains at least one mold provided with a side wall, inside which there is mounted a sliding bottom configured to slide in vertical direction and provided with a central core.

15. An installation according to claim 11, wherein the assembly line contains a station for placing reinforcing layers upstream from the station for establishing insertion relationships.

16. An installation according to claim 11, further comprising a machine for production of blanks provided with a central hole and wherein the assembly line contains a station for placing central bushings upstream from the station for placing reinforcing layers.

17. An installation according to claim 11, wherein the assembly line contains a heating station upstream from the pressing station.

18. An installation according to claim 11, wherein the assembly line contains at least one station at which there are successively superposed at least a first reinforcing layer, a first layer of abrasive grains, a second reinforcing layer, a second layer of abrasive grains, and a third reinforcing layer.

* * * * *